United States Patent [19]

Ball

[11] Patent Number: 4,517,937

[45] Date of Patent: May 21, 1985

[54] INTERNAL COMBUSTION ENGINE

[76] Inventor: Herbert Ball, Peny Graig, Saron, Llandyssul, Dyfed, Wales, SA44 5EW

[21] Appl. No.: 533,966

[22] Filed: Sep. 20, 1983

[30] Foreign Application Priority Data

Sep. 21, 1982 [GB] United Kingdom ..... 8226883

[51] Int. Cl.[3] ..... F01L 7/00

[52] U.S. Cl. ..... 123/190 D; 123/80 D; 123/190 B

[58] Field of Search ..... 123/190 D, 190 BB, 80 D, 123/190 R, 190 B, 190 E

[56] References Cited

U.S. PATENT DOCUMENTS

| | | | |
|---|---|---|---|
| 1,085,604 | 2/1914 | Guillary | 123/190 D |
| 1,382,053 | 6/1921 | Black | 123/190 D |
| 1,799,759 | 4/1931 | McDowell | 123/190 D |
| 2,296,081 | 9/1942 | Aspin | 123/190 D |
| 2,947,295 | 8/1960 | Aspin | 123/80 D |

FOREIGN PATENT DOCUMENTS

| | | | |
|---|---|---|---|
| 436462 | 3/1912 | France | 123/190 D |
| 56213 | 12/1911 | Switzerland | 123/190 D |
| 159272 | 2/1921 | United Kingdom | 123/190 D |
| 637362 | 5/1950 | United Kingdom | 123/190 D |
| 683814 | 12/1952 | United Kingdom | 123/190 D |
| 691275 | 5/1953 | United Kingdom | 123/190 D |

*Primary Examiner*—Ronald H. Lazarus

*Attorney, Agent, or Firm*—Fleit, Jacobson, Cohn & Price

[57] ABSTRACT

A four stroke internal combustion engine comprising a cylinder block in which is formed a cylinder bore, a piston arranged for reciprocation within the cylinder bore, a cylinder head mounted on the cylinder block and having a conical valve seat embodying inlet and exhaust ports, a conical valve complementary with the valve seat and embodying port hole means via which the inlet or exhaust ports are arranged to communicate with the cylinder bore consequent upon predetermined rotary movement of the valve, and valve rotating means operative to produce at appropriate times during the engine cycle, predetermined rotary movement of the valve in one direction so as to place the inlet port in communication with the cylinder bore via the port hole means or predetermined rotary movement of the valve in the opposite direction so as to place the exhaust port in communication with the cylinder bore via the port hole means.

11 Claims, 8 Drawing Figures

INTERNAL COMBUSTION ENGINE

This invention relates to four stroke internal combustion engines and more especially it relates to four stroke engines which incorporate a conical valve or valves.

Conical valve arrangements which embody conical valves continuously rotatable on a conical seat to open and close fuel inlet and exhaust ports are known, but in known conical valve arrangements, conical valve surfaces and the surfaces of complementary valve seats tend rapidly to deteriorate in use so that the seal between the valve and the seat is destroyed. This deterioration of the mating surfaces is due principally to movement produced between the surfaces during periods when they are urged into intimate contact by combustion pressure.

It is an object of the present invention to provide an internal combustion engine incorporating a conical valve or valves wherein rapid deterioration of the mating surfaces is largely obviated.

According to the present invention a four stroke internal combustion engine comprises a cylinder block in which is formed a cylinder bore, a piston arranged for reciprocation within the cylinder bore, a cylinder head mounted on the cylinder block and having a conical valve seat embodying inlet and exhaust ports, a conical valve complementary with the valve seat and embodying port hole means via which the inlet or exhaust ports are arranged to communicate with the cylinder bore consequent upon predetermined rotary movement of the valve, and valve rotating means operative to produce at appropriate times during the engine cycle, predetermined rotary movement of the valve in one direction so as to place the inlet port in communication with the cylinder bore via the port hole means or predetermined rotary movement of the valve in the opposite direction so as to place the exhaust port in communication with the cylinder bore via the port hole means, whereby continuous valve rotation is not produced and the valve is stationary during periods of the engine cycle wherein high pressure is present in a combustion chamber with which the cylinder bore is placed in communication, whereby wear of mating surfaces of the conical valve and the valve seat are minimized and valve life is increased.

The valve may be biased into contact with the valve seat by means of a coil spring.

The valve may include a stem which passes through the cylinder head and which is embraced by the coil spring, the coil spring being received within a recess formed in the cylinder head on a side thereof opposite the side in which the valve seat is positioned, so as to act between the cylinder head and the valve stem for biassing purposes.

The valve rotating means may comprise a drive shaft disposed substantially orthogonally of the cylinder bore and substantially parallel with the crank shaft of the engine, and arranged to be driven by the engine at half the crank shaft speed, actuator means rotatable with the drive shaft, and valve drive member means secured to the valve stem and extending to each side of the stem, the actuator means being arranged to co-operate in driving engagement with the valve drive member means extending to one side of the stem for producing rotation of the valve in one direction and similarly to co-operate with the valve drive member means extending to the other side of the stem for producing rotation of the valve in the opposite direction.

The actuator means may comprise levers arranged in pairs spaced apart along the drive shaft with two pairs for each valve, one pair being arranged to co-operate with the drive member means extending to one side of the stem and the other pair being arranged to co-operate with the drive member means extending to the other side of the stem.

The valve drive member means may comprise side surface parts of radially extending actuator bars which form a part of a drive plate assembly secured to the valve stem.

The actuator means and the valve drive member means may alternatively take any convenient form and for example the actuator means may comprise push rods clamped to circular plates, cams, levers moved by cams, driving pins which co-operate with rollers, or a hydraulic system including hydraulically operated actuator means.

The valve may comprise a hollow conical shell, the conical wall of which is cut away to define the port hole means.

The wall may be of substantially uniform thickness, or alternatively it may be thicker in some regions to withstand relatively high combustion pressures.

The port hole means may comprise a single passageway which is placed in communication with the exhaust port when the valve is rotated in one direction and which, when the valve is rotated in the opposite direction, is placed in communication with the inlet port.

Alternatively, the port hole means may comprise two passageways one of which serves exclusively for the transfer of exhaust gases and the other of which serves exclusively for the transfer of fuel and air.

The passageways may communicate with port hole apertures arranged in spaced apart relationship in the outer conical valve surface, the apertures being arranged to lie on a common radial plane of the valve.

In an alternative arrangement the passageways may be off-set with respect to a common radial plane through the valve and the inlet and exhaust ports may be positioned accordingly.

The valve rotating means may include indexing means operative temporarily to hold the valve stationary in predetermined angular positions corresponding to inlet and exhaust port open and closed states during the engine cycle.

Some embodiments of the invention will now be described solely by way of example with reference to the accompanying drawings in which.

Figure 1:
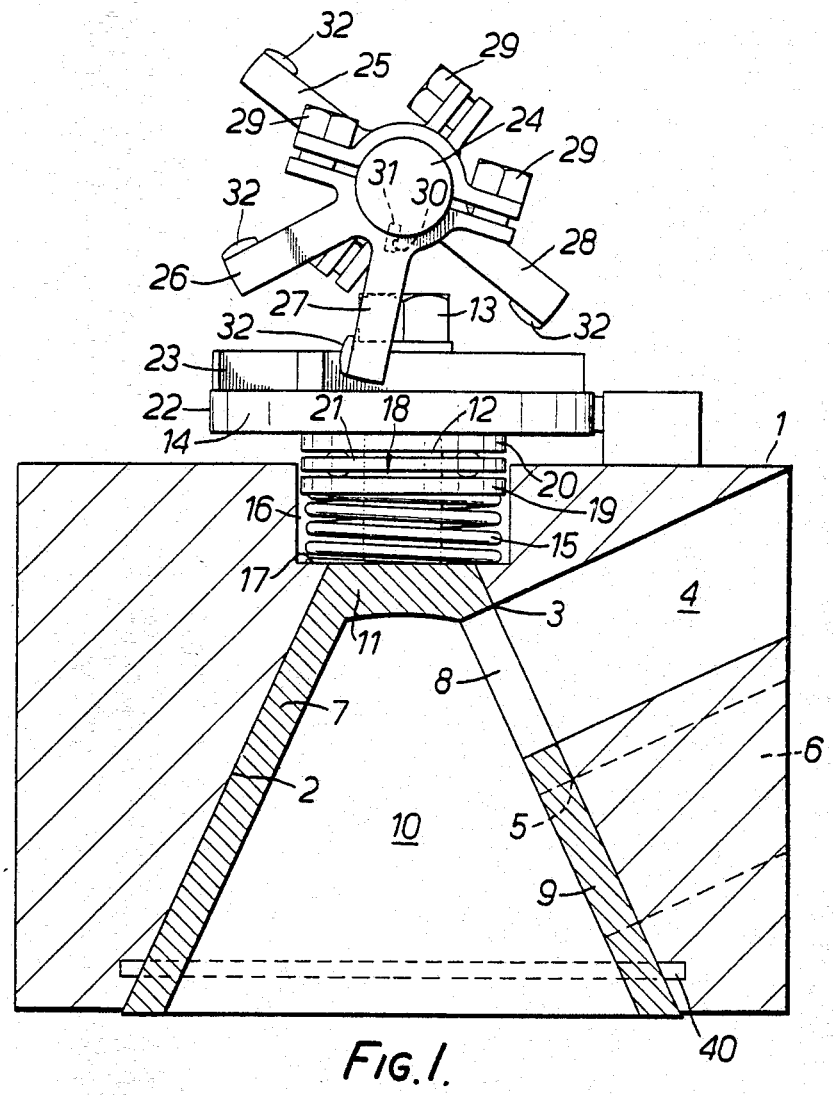
FIG. 1 is a front elevation partly in section of a part of a cylinder head embodying a conical valve arrangement.
Figure 2:
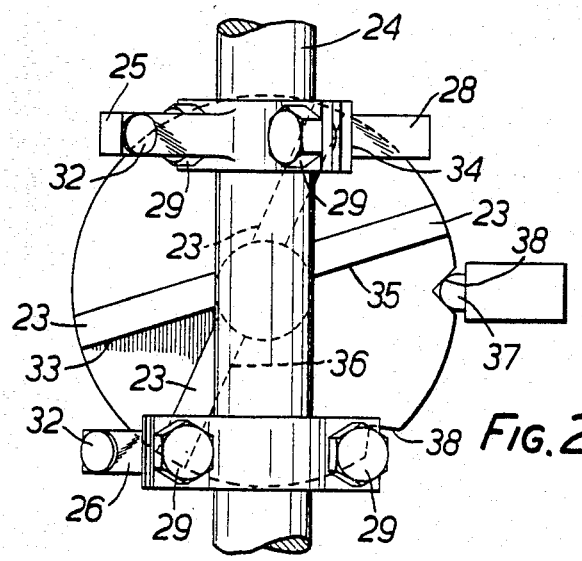
FIG. 2 is a plan view of a part of the arrangement shown in FIG. 1.
Figure 3A:
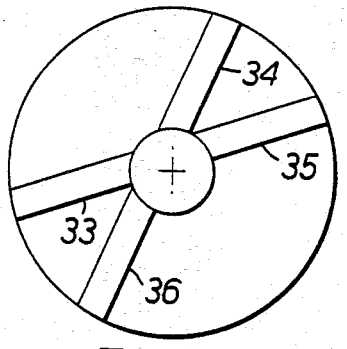
Figure 3B:
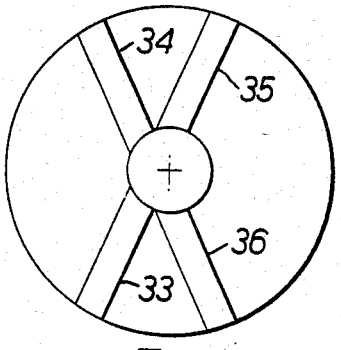
Figure 3C:
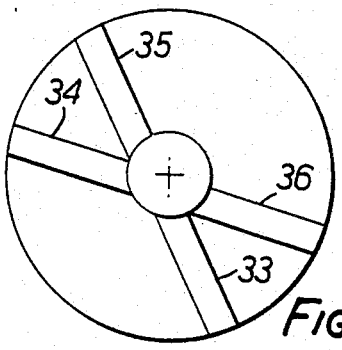
Figure 4:
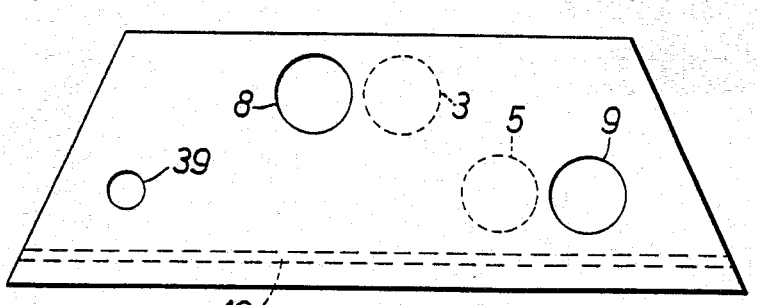
Figure 5:
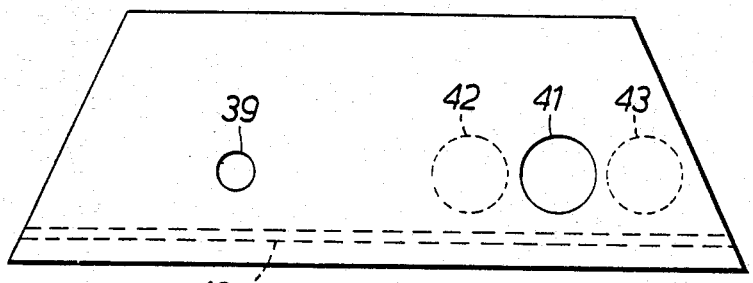
Figure 6:
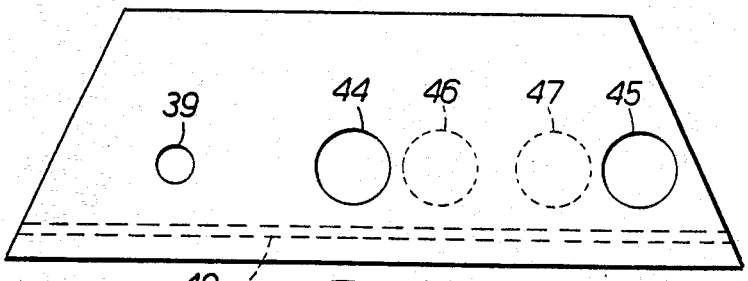

FIG. 3*a*, FIG. 3*b* and FIG. 3*c* are generally schematic plan views of a part of the valve operating arrangement shown in FIGS. 1 and 2 in various operational positions;

FIG. 4 is a development view of the conical surface of the valve forming part of the arrangement shown in FIG. 1;

FIG. 5 is a development view of the conical surface of an alternative valve for use with an alternative valve arrangement; and FIG. 6 is a development view of the conical surface of a valve for use with another alternative arrangement.

Referring now to the drawings, a four stroke combustion engine comprises a cylinder head 1 only part of which is shown in FIG. 1. The cylinder head 1 is machined to define a conical valve seat 2, in which is formed an inlet port aperture 3 which extends to define an inlet port passageway 4, and an exhaust port aperture 5 which extends to define an exhaust port passageway 6. The exhaust port passageway 6 is provided on a lower radial plane through the valve and in a different angular position and is shown in FIG. 1 by means of broken lines. The positional relationship between the inlet port aperture 3 and the exhaust port aperture 5 can be more clearly seen in the development view of FIG. 4.

The valve seat 2 is arranged to receive a hollow conical valve 7 having formed therein an inlet porthole 8 and an exhaust porthole 9 which is shown by broken lines in FIG. 1. The space within the valve 7 forms a part of a combustion chamber 10 of an engine (not shown) with which the cylinder head 1 is associated. Extending from a narrow end 11 of the valve 7 there is provided a valve stem 12 on which a screw thread is cut to receive a nut 13 which serves to secure a valve actuator plate 14 so that it is rotatable with the valve 7. In order to bias the valve 7 against the valve seat 2, a coil spring 15 is provided which is received in a recess 16 in the cylinder head 1 and which acts between a lower surface 17 of the recess 16 and a bearing 18. The bearing 18 is a normal ball thrust bearing comprising a ball retainer and spacer 21, an upper plate 20 and a lower plate 19, having in them the peripheral grooves in which the ball bearings rotate. The whole ball thrust bearing is one unit in operation, but three separate parts for assembly. The plate 20 is clamped between the actuator plate 14 and the shoulder of the valve stem 12, making it a permanent fixture. The plate 19 is secured to the spring by a collar extending tightly into the spring inner diameter, keeping it stationary.

The valve actuator plate 14 comprises a lower plate 22 positioned in contact with the plate 20 of the bearing 18 and an upper part comprising radially extending actuator bars 23, the actuator bars 23 and the lower plate 22 being arranged to rotate together with the valve 7.

Mounted above the valve 7 there is provided a drive shaft 24 which in operation of the engine is arranged to rotate at half the crank shaft speed. Secured to the drive shaft 24 there are provided drive members taking the form of levers 25, 26, 27 and 28, which are secured to the shaft 24 by means of bolts 29 and a key 30 which engages with a complementary keyway 31 in the shaft 24 whereby the levers 25, 26, 27 and 28 are rotatable with the shaft 24. In practice, one key 30 would be fitted to each pair of levers, the second key 30 being not shown for clarity. As the levers 25, 26, 27 and 28 rotate with the shaft 24, contact pads 32 on the ends of the levers are arranged to contact side surfaces 33, 34, 35 and 36 of the radially extending actuator bars 23 sequentially so that the valve 7 is constrained to rotate in one direction for exhaust valve operation and in the other direction for inlet valve operation. The levers 25 and 28 are mounted on the shaft 24 to one side of the valve 7 and the levers 26, 27 are mounted on the shaft 24 to the other side of the valve 7, as can be seen most clearly in FIG. 2, and thus the levers 25 and 28 serve to drive the valve in one direction consequent upon rotation of the shaft 24 and the levers 26 and 27 serve to drive the valve 7 in the opposite direction consequent upon rotation of the shaft 24.

The angular position of the radially extending actuator bars 23 when the inlet port aperture 3 is open, is shown in FIG. 3*a*. The valve 7 is moved from this position as shown in FIG. 3*a* by the lever 28 which acts against the side face 34 to rotate the valve 7 so that the inlet port is closed. The position of the radially extending actuator bars 23 when the inlet port is closed is shown in FIG. 3*b*. In order to move the valve from this position and to rotate the valve 7 so that the exhaust port aperture 5 is open, lever 25 acts against the side face 35. The angular position of the radially extending actuator bars when the exhaust port aperture 5 is opened is shown in FIG. 3*c*. The exhaust port aperture 5 is closed by operation of the lever 26 acting against the surface 33, and the inlet port is opened once again by operation of the lever 27 acting against the side face 36.

In order to hold the valves stationary in the various operating positions, an indexing mechanism is provided comprising a spring loaded projection 37 which engages a notch 38 formed in the periphery of the lower plate 22. It will be appreciated that notches 38 are provided corresponding to the three stationary operating states of the valve as shown in FIGS. 3*a*, 3*b* and 3*c*. In order to place a spark plug in direct communication with the combustion chamber 10, a plug hole port 39 (see FIGS. 4, 5 and 6) is provided in the conical wall of the valve 7 which communicates with a plug (not shown) which is mounted in the cylinder head 1. For lubrication of the valve, oil is piped to the operating shaft 24 bearings and the actuator plate 14. The oil runs down to the thrust bearing, the conical face and seating, and any excess collects in the channel 40 at the base of the valve for drainage back to the engine sump.

Various modifications may be made to the arrangements thus far described without departing from the scope of the invention and for example a valve may be provided having a single porthole 41 as shown in FIG. 5 which is rotated in one direction so as to align with an exhaust port 42 and in the opposite direction so as to align with an inlet port 43. In an alternative arrangement, inlet and exhaust ports may be provided on the same radial plane as shown in FIG. 6 which is a development of a conical valve having an inlet porthole 44 and an exhaust porthole 45 arranged in the same radial plane for communication with an inlet port 46 and an exhaust port 47 respectively of a cylinder head (not shown).

With the arrangement thus far described it will be appreciated that clockwise rotation of the valve 7 is envisaged but it will be apparent that if the position on the shaft 24 of the levers 25 and 28 and the levers 26 and 27 is reversed, anti-clockwise valve operation will be produced and the valve construction must be changed accordingly. Although the arrangement just before described with reference to the accompanying drawings utilises a valve actuator comprising levers it will be appreciated by those skilled in the art that any alternative mechanism may be employed such as a driving pin and roller assembly, a cam operated driving arrangement or a hydraulic system.

The shaft 24 which drives the levers as shown in FIGS. 1 and 2 may conveniently be utilized for driving an ignition distributor and it is clear that an engine may be designed in accordance with the foregoing principles having two or more cylinders. It would normally be arranged that the drive shaft 24 is arranged to be parallel or substantially parallel with the crank shaft, but alternative configurations are possible involving more complex designs.

In the arrangement shown in FIG. 1, the wall thickness of the valve 7 is substantially uniform but for high compression operation it may be desirable to increase the thickness of the valve wall in places and in this case it will be apparent that less of the combustion chamber will be included within the body of the valve. In operation of engines according to the present invention it will be appreciated that the fuel inlet stream is arranged substantially directly over the piston which contributes significantly to the volumetric efficiency of the ignition process. Similarly, low impedence to exhaust gases is offered during exhaust strokes which facilitates efficient scouring of the combustion chamber.

The valves in an engine according to the present invention are stationary for about half of the engine cycle and valve movement is minimised during high pressure parts of the cycle. No tappet noise is produced in operation resulting in a quieter and smoother running engine and maintainance is minimised. Special port and porthole shapes and careful positioning of the operating levers allow the port "full open" period to be extended to the maximum which increases volumetric efficiency. Since the fuel stream entrance is directly over the piston combustion chamber, turbulence is high which also increases volumetric efficiency. As the power required to rotate the valve is only a fraction of that required to drive a cam shaft, a substantial increase in power output can be obtained over the power expected from engines with conventional valve systems utilising a cam shaft.

We claim:

1. A four stroke internal combustion engine comprising a cylinder block in which is formed a cylinder bore, a piston arranged for reciprocation within the cylinder bore, a cylinder head mounted on the cylinder block and having a conical valve seat embodying inlet and exhaust ports, a conical valve complementary with the valve seat and embodying port hole means via which the inlet or exhaust ports are arranged to communicate with the cylinder bore consequent upon predetermined rotary movement of the valve, and valve rotating means operative to produce at appropriate times during the engine cycle, predetermined rotary movement of the valve in one direction so as to place the inlet port in communication with the cylinder bore via the port hole means or predetermined rotary movement of the valve in the opposite direction so as to place the exhaust port in communication with the cylinder bore via the port hole means, and indexing means operative temporarily to hold the valve stationary during periods of the engine cycle when high pressure is present in a combustion chamber with which the cylinder bore is placed in communication for minimizing wear of mating surfaces of the valve and the valve seat.

2. A four stroke internal combustion engine according to claim 1 in which the valve is biased into contact with the valve seat by means of a coil spring, and in which the valve includes a stem which passes through the cylinder head and which is embraced by the coil spring, the coil spring being received within a recess formed in the cylinder head on a side thereof opposite the side in which the valve seat is positioned, so as to act between the cylinder head and the valve stem for biasing purposes.

3. A four stroke internal combustion engine according to claim 1 in which the valve rotating means comprises a drive shaft disposed substantially orthogonally of the cylinder bore and substantially parallel with the crank shaft of the engine, and arranged to be driven by the engine at half the crank shaft speed, actuator means rotatable with the drive shaft, and valve drive member means secured to the valve stem and extending to each side of the stem, the actuator means being arranged to co-operate in driving engagement with the valve drive member means extending to one side of the stem for producing rotation of the valve in one direction and similarly to co-operate with the valve drive member means extending to the other side of the stem for producing rotation of the valve in the opposite direction.

4. A four stroke internal combustion engine according to claim 1 in which the valve rotating means comprises a drive shaft disposed substantially orthogonally of the cylinder bore and substantially parallel with the crank shaft of the engine, and arranged to be driven by the engine at half the crank shaft speed, actuator means rotatable with the drive shaft, and valve drive member means secured to the valve stem and extending to each side of the stem, the actuator means being arranged to co-operate in driving engagement with the valve drive member means extending to one side of the stem for producing rotation of the valve in one direction and similarly to co-operate with the valve drive member means extending to the other side of the stem for producing rotation of the valve in the opposite direction, and in which the actuator means comprises levers arranged in pairs spaced apart along the drive shaft with two pairs for each valve, one pair being arranged to co-operate with the drive member means extending to one side of the stem and the other pair being arranged to co-operate with the drive member means extending to the other side of the stem.

5. An internal combustion engine according to claim 1 in which the valve rotating means comprises a drive shaft disposed substantially orthogonally of the cylinder bore and substantially parallel with the crank shaft of the engine, and arranged to be driven by the engine at half the crank shaft speed, actuator means rotatable with the drive shaft, and valve drive member means secured to the valve stem and extending to each side of the stem, the actuator means being arranged to co-operate in driving engagement with the valve drive member means extending to one side of the stem for producing rotation of the valve in one direction and similarly to co-operate with the valve drive member means extending to the other side of the stem for producing rotation of the valve in the opposite direction, in which the actuator means comprises levers arranged in pairs spaced apart along the drive shaft with two pairs for each valve, one pair being arranged to co-operate with the drive member means extending to one side of the stem and the other pair being arranged to co-operate with the drive member means extending to the other side of the stem, and in which the drive member means comprises side surface parts of radially extending actuator bars which form a part of a drive plate assembly secured to the valve stem.

6. A four stroke internal combustion engine according to claim 1 in which the valve comprises a hollow conical shell, the conical wall of which is cut away to define the port hole means.

7. A four stroke internal combustion engine according to claim 1 in which the port hole means comprises a single passageway which is placed in communication with the exhaust port when the valve is rotated in one direction and which, when the valve is rotated in the opposite direction, is placed in communication with the inlet port.

8. A four stroke internal combustion engine according to claim 1 in which the port hole means comprises two passageways one of which serves exclusively for the transfer of exhaust gases and the other of which serves exclusively for the transfer of fuel and air.

9. A four stroke internal combustion engine according to claim 1 in which the port hole means comprises two passageways one of which serves exclusively for the transfer of exhaust gases and the other of which serves exclusively for the transfer of fuel and air, and in which the passageways communicate with port hole apertures arranged in spaced apart relationship in the outer conical valve surface, the apertures being arranged to lie on a common radial plane of the valve.

10. A four stroke internal combustion engine according to claim 1 in which the port hole means comprises two passageways one of which serves exclusively for the transfer of exhaust gases and the other of which serves exclusively for the transfer of fuel and air, and in which the passageways are off-set with respect to a common radial plane through the valve.

11. A four stroke internal combustion engine according to claim 1 in which the indexing means is operative temporarily to hold the valve stationary in predetermined angular positions corresponding to inlet and exhaust port open and closed states during the engine cycle.

* * * * *